US010251005B2

(12) United States Patent
Sapozhnykov

(10) Patent No.: US 10,251,005 B2
(45) **Date of Patent: *Apr. 2, 2019**

(54) METHOD AND APPARATUS FOR WIND NOISE DETECTION

(71) Applicant: Cirrus Logic International Semiconductor Ltd., Edinburgh (GB)

(72) Inventor: Vitaliy Sapozhnykov, Cremorne (AU)

(73) Assignee: Cirrus Logic, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/855,556

(22) Filed: Dec. 27, 2017

(65) Prior Publication Data

US 2018/0176704 A1 Jun. 21, 2018

Related U.S. Application Data

(63) Continuation of application No. 15/324,091, filed as application No. PCT/AU2015/050406 on Jul. 21, 2015, now Pat. No. 9,906,882.

(30) Foreign Application Priority Data

Jul. 21, 2014 (AU) ..... 2014902804
Jan. 29, 2015 (AU) ..... 2015900265

(51) Int. Cl.
*H04R 29/00* (2006.01)
*H04R 3/00* (2006.01)
(Continued)

(52) U.S. Cl.
CPC ..... *H04R 29/004* (2013.01); *H04R 3/005* (2013.01); *G10L 21/0208* (2013.01);
(Continued)

(58) Field of Classification Search
CPC .. H04R 2430/03; H04R 29/004; H04R 3/005; H04R 2410/07; H04R 2410/01; H04R 25/00; G10L 21/0208
(Continued)

(56) References Cited

U.S. PATENT DOCUMENTS 6,882,736 B2 4/2005 Dickel et al.
7,171,008 B2 1/2007 Elko
(Continued)

FOREIGN PATENT DOCUMENTS

JP 2011030022 A 2/2011
WO 2013091021 A1 6/2013

OTHER PUBLICATIONS

International Search Report and Written Opinion of the International Searching Authority, International Application No. PCT/AU2015/050406, 10 pages.
(Continued)

*Primary Examiner* — Paul Kim
(74) *Attorney, Agent, or Firm* — Jackson Walker L.L.P.

(57) ABSTRACT

Processing digitized microphone signal data in order to detect wind noise. A first signal and a second signal are obtained from at least one microphone. The first and second signals reflect a common acoustic input, and are either temporally distinct or spatially distinct, or both. The first signal is processed to determine a first distribution of the samples of the first signal. The second signal is processed to determine a second distribution of the samples of the second signal. A difference between the first distribution and the second distribution is calculated. If the difference exceeds a detection threshold, an indication is output that wind noise is present.

21 Claims, 7 Drawing Sheets

(51) Int. Cl.
*H04R 25/00* (2006.01)
*G10L 21/0208* (2013.01)

(52) U.S. Cl.
CPC ..... *H04R 25/00* (2013.01); *H04R 2410/01* (2013.01); *H04R 2410/07* (2013.01); *H04R 2430/03* (2013.01)

(58) Field of Classification Search
USPC ..... 381/56
See application file for complete search history.

(56) References Cited

U.S. PATENT DOCUMENTS 7,340,068 B2 3/2008 Petersen et al.
7,464,029 B2 * 12/2008 Visser ..... G10L 21/0272
704/210

OTHER PUBLICATIONS

Visser, E. et al., "A spatio-temporal speech enhancement scheme for robust speech recognition in noisy environments", Speech Communication 41 (2003) 393-407.
Wilson, Keith D. et al., "Discrimination of Wind Noise and Sound Waves by Their Contrasting Spatial and Temporal Properties", Acta Acustica United With Acustica, vol. 96 (2010) 991-1002.

* cited by examiner

METHOD AND APPARATUS FOR WIND NOISE DETECTION

This application is a continuation of U.S. Non-Provisional patent application Ser. No. 15/324,091, filed Jan. 5, 2017, which is a 371 application of International Application No. PCT/AU2015/050406, files Jul. 21, 2015, which claims priority to Australian Patent Application Serial No. 2014902804, filed Jul. 21, 2014, and Australian Patent Application Serial No. 2015900265, filed Jan. 29, 2015, all of which are incorporated by reference herein in their entirety.

TECHNICAL FIELD

The present invention relates to the digital processing of signals from microphones or other such transducers, and in particular relates to a device and method for detecting the presence of wind noise or the like in such signals, for example to enable wind noise compensation or suppression to be initiated or controlled.

BACKGROUND OF THE INVENTION

Wind noise is defined herein as a microphone signal generated from turbulence in an air stream flowing past a microphone port or over a microphone membrane, as opposed to the sound of wind blowing past other objects such as the sound of rustling leaves as wind blows past a tree in the far field. Wind noise is impulsive and often has an amplitude large enough to exceed the nominal speech amplitude. Wind noise can thus be objectionable to the user and/or can mask other signals of interest. It is desirable that digital signal processing devices are configured to take steps to ameliorate the deleterious effects of wind noise upon signal quality. To do so requires a suitable means for reliably detecting wind noise when it occurs, without falsely detecting wind noise when in fact other factors are affecting the signal.

Previous approaches to wind noise detection (WND) assume that non-wind sounds are generated in the far field and thus have a similar sound pressure level (SPL) and phase at each microphone, whereas wind noise is substantially uncorrelated across microphones. However, for non-wind sounds generated in the far field, the SPL between microphones can substantially differ due to localized sound reflections, room reverberation, and/or differences in microphone coverings, obstructions, or location such as due to orthogonal plane placement of microphones on a smartphone with one looking inwards and the other looking outwards. Substantial SPL differences between microphones can also occur with non-wind sounds generated in the near field, such as a telephone handset held close to the microphones. Differences in microphone output signals can also arise due to differences in microphone sensitivity, i.e. mismatched microphones, which can be due to relaxed manufacturing tolerances for a given model of microphone, or the use of different models of microphone in a system.

The spacing between the microphones causes non-wind sounds to have different phase at each microphone sound inlet, unless the sound arrives from a direction where it reaches both microphones simultaneously. In directional microphone applications, the axis of the microphone array is usually pointed towards the desired sound source, which gives the worst-case time delay and hence the greatest phase difference between the microphones.

When the wavelength of a received sound is much greater than the spacing between microphones. i.e. at low frequencies, the microphone signals are fairly well correlated and previous WND methods may not falsely detect wind at such frequencies. However, when the received sound wavelength approaches the microphone spacing, the phase difference causes the microphone signals to become less correlated and non-wind sounds can be falsely detected as wind. The greater the microphone spacing, the lower the frequency above which non-wind sounds will be falsely detected as wind, i.e. the greater the portion of the audible spectrum in which false detections will occur. False detection may also occur due to other causes of phase differences between microphone signals, such as localized sound reflections, room reverberation, and/or differences in microphone phase response or inlet port length. Given that the spectral content of wind noise at microphones can extend from below 100 Hz to above 10 kHz depending on factors such as the hardware configuration, the presence of a user's head or hand, and the wind speed, it is desirable for wind noise detection to operate satisfactorily throughout much if not all of the audible spectrum, so that wind noise can be detected and suitable suppression means activated only in sub bands where wind noise is problematic.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In this specification, a statement that an element may be "at least one of" a list of options is to be understood that the element may be any one of the listed options, or may be any combination of two or more of the listed options.

SUMMARY OF THE INVENTION

According to a first aspect the present invention provides a method of processing digitized microphone signal data in order to detect wind noise, the method comprising:

obtaining a first signal and a second signal from at least one microphone, the first and second signals reflecting a common acoustic input, and the first and second signals being at least one of temporally distinct and spatially distinct;

processing the first signal to determine a first distribution of the samples of the first signal;

processing the second signal to determine a second distribution of the samples of the second signal;

calculating a difference between the first distribution and the second distribution; and if the difference exceeds a detection threshold, outputting an indication that wind noise is present.

According to a second aspect the present invention provides a device for detecting wind noise, the device comprising:

at least a first microphone; and a processor configured to:

obtain a first signal and a second signal from the at least one microphone, the first and second signals reflecting a common acoustic input, and the first and second signals being at least one of temporally distinct and spatially distinct;

process the first signal to determine a first distribution of the samples of the first signal;

process the second signal to determine a second distribution of the samples of the second signal;

calculate a difference between the first distribution and the second distribution; and if the difference exceeds a detection threshold, output an indication that wind noise is present.

According to a third aspect the present invention provides a computer program product comprising computer program code means to make a computer execute a procedure for wind noise detection, the computer program product comprising:

computer program code means for obtaining a first signal and a second signal from at least one microphone, the first and second signals reflecting a common acoustic input, and the first and second signals being at least one of temporally distinct and spatially distinct, computer program code means for processing the first signal to determine a first distribution of the samples of the first signal;

computer program code means for processing the second signal to determine a second distribution of the samples of the second signal;

computer program code means for calculating a difference between the first distribution and the second distribution; and computer program code means for, if the difference exceeds a detection threshold, outputting an indication that wind noise is present.

The computer program product may comprise a non-transitory computer readable medium.

The present invention recognises that wind noise affects the distribution of signal sample magnitudes within a microphone signal and, due to the unique form of the localised air stream flowing past each microphone at any given moment, affects the distribution differently from one microphone to the next and also affects the distribution differently from one moment to the next at each microphone. Wind-induced noise is non-stationary so its statistics vary in time. Thus, increased wind will tend to increase the difference between the first distribution and the second distribution, making this a beneficial metric for the presence or absence of wind noise. Assessing the short-term distributions of the first and second signals enables wind noise to be quantified from the difference between the corresponding distributions. Moreover, by considering the difference between the distributions of the signal sample magnitudes, the method of the present invention effectively ignores phase differences between microphone signals.

The first and second signals reflect a common acoustic input within which the presence or absence of wind noise is desired to be detected. The first and second signals may in some embodiments be made to be temporally distinct by taking temporally distinct samples from a single microphone signal, or by taking temporally distinct samples from more than one microphone signal. The degree to which the first and second signals are temporally distinct, for example the sample spacing between the first and second signals, is preferably less than a typical time of change of non-wind noise sources or signal sources, so that changes in the first and second distributions will be dominated by wind noise and minimally affected by relatively slowly changing signal sources. For example, the first signal may comprise a first frame of a microphone signal and the second signal may comprise a subsequent frame of the microphone signal, so that at typical audio sampling rates the first and second signals are temporally distinct by less than a millisecond and more preferably by 125 microseconds or less.

Additionally or alternatively, the first and second signals may in some embodiments be made to be spatially distinct by taking the first signal from a first microphone and taking the second signal from a second microphone spaced apart from the first microphone. Some embodiments may further comprise determining distributions of both temporally distinct signals and spatially distinct signals to produce a composite indication of whether wind noise is present.

The distribution of the first and second signals may be determined in any appropriate manner and may comprise a simplified distribution. For example the distribution determined may comprise a cumulative distribution of signal sample magnitude, determined only at one or more selected values. Calculating the difference between the first distribution and the second distribution may in some embodiments be performed by calculating the point-wise difference between the first and second distribution at each selected value, and summing the absolute values of the point-wise differences to produce a measure of the difference between the first distribution and the second distribution. In such embodiments the value of the cumulative distribution of each signal for example may be determined at between three and 11 selected values across an expected range of values of signal sample magnitude.

In preferred embodiments of the invention, each microphone signal is preferably high pass filtered, for example by pre-amplifiers or ADCs, to remove any DC component, such that the sample values operated upon by the present method will typically contain a mixture of positive and negative numbers. Moreover, each microphone signal is preferably matched for amplitude so that an expected variance of each signal is the same or approximately the same. In some embodiments the first and second microphones are matched for an acoustic signal of interest before the wind noise detection is performed. For example the microphones may be matched for speech signals.

The method of the invention may be performed on a frame-by-frame basis by comparing the distribution of samples from a single frame of each signal obtained contemporaneously. The difference between the first distribution and the second distribution may in some embodiments be smoothed over multiple frames, for example by use of a leaky integrator.

The detection threshold may be set to a level which is not triggered by light winds which are deemed unobtrusive, such as wind below 1 or 2 $m \cdot s^{-1}$.

The magnitude of the difference between the first distribution and the second distribution may be used to estimate the strength of the wind in otherwise quiet conditions, or the degree to which wind noise is dominating other sounds present, at least within clipping limits.

In some embodiments the method may be performed in respect of one or more sub-bands of a spectrum of the signal. Such embodiments may thus detect the presence or absence of wind noise in each such sub-band and may thus permit subsequent wind noise reduction techniques to be selectively applied only in each sub-band in which the presence of wind noise has been detected. In such embodiments, the detection of wind noise is preferably first performed in respect of a lower frequency sub-band, and is only performed in respect of a higher frequency sub-band if wind noise is detected in the lower frequency sub-band. Such embodiments recognise that wind-noise generally reduces with increasing frequency, so that if no wind noise is detected at low frequencies it can be assumed that there is no wind-noise at higher frequencies, and thus there is no need to waste processor cycles in detecting wind noise at higher frequencies.

In embodiments where wind noise detection is performed in respect of one or more sub-bands, the sub-band(s) within which the presence of wind noise is detected may be used to estimate the strength of the wind. Such embodiments recognise that light winds give rise to wind noise only in lower frequency sub-bands, with wind noise appearing in higher sub-bands as wind strength increases.

In some embodiments of the invention, wind noise reduction may subsequently be applied to the first and second signals. In embodiments where wind noise detection is performed in respect of one or more sub-bands, wind noise reduction is preferably applied only in respect of those sub-bands in which wind noise has been detected.

The first and second microphones may be part of a telephony headset or handset, or other audio devices such as cameras, video cameras, tablet computers, etc. Alternatively the first and second microphones may be mounted on a behind-the-ear (BTE) device, such as a shell of a cochlear implant BTE unit, or a BTE, in-the-ear, in-the-canal, completely-in-canal, or other style of hearing aid. The signal may be sampled at 8 kHz, 16 kHz or 48 kHz, for example. Some embodiments may use longer block lengths for higher sampling rates so that a single block covers a similar time frame. Alternatively, the input to the wind noise detector may be down sampled so that a shorter block length can be used (if required) in applications where wind noise does not need to be detected across the entire bandwidth of the higher sampling rate. The block length may be 16 samples, 32 samples, or other suitable length.

BRIEF DESCRIPTION OF THE DRAWINGS

An example of the invention will now be described with reference to the accompanying drawings, in which.

DESCRIPTION OF THE PREFERRED EMBODIMENTS

The present invention recognises that wind noise energy is concentrated at the low portion of the spectrum; and that with increased wind velocity the wind noise occupies progressively more and more bandwidth. The bandwidth and amplitude of wind noise depend on the wind speed, wind direction, the device position with respect to the user's body, and device design. As wind noise energy for many wind noise situations is mainly located at low frequencies, a significant portion of the speech spectrum remains relatively unaffected by it.

Therefore in order to preserve the naturalness of the processed audio signal, some embodiments of the present invention recognise that wind-noise reduction techniques which attempt to reduce wind noise energy while preserving signal (e.g. speech) energy, should be applied selectively only to the portion of spectrum affected by wind noise. Thus the "wind noise-free" parts of the speech signal spectrum will not be unnecessarily modified by the system. Hence, this selective reduction of wind noise requires an intelligent detection method which can detect wind presence in particular spectral sub-bands and determine its direction with respect to the device.

Figure 1:
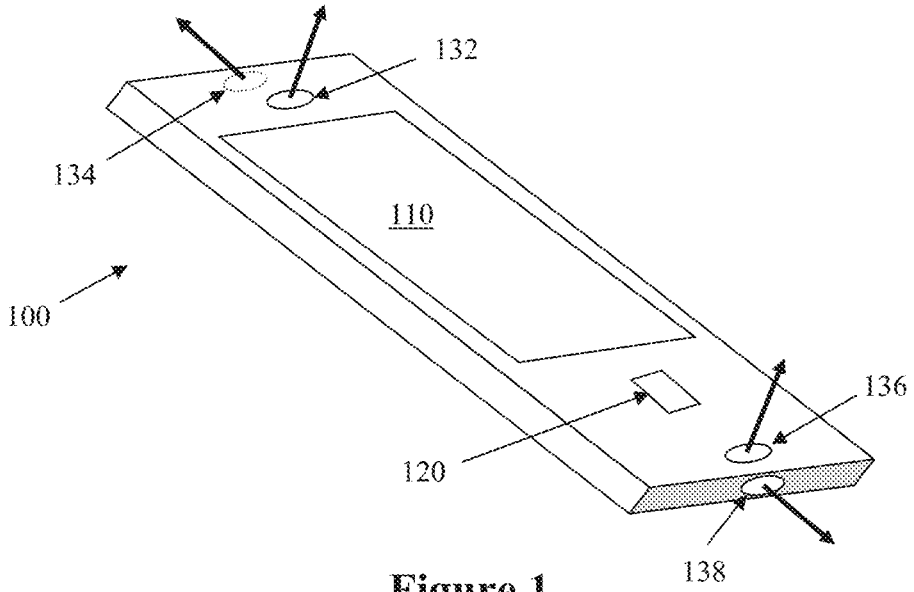
FIG. 1 illustrates a handheld device in respect of which the method of the present invention may be applied.

FIG. 1 illustrates a handheld device 100 with touchscreen 110, button 120 and microphones 132, 134, 136, 138. The following embodiments describe the capture of audio using such a device, for example to accompany a video recorded by a camera (not shown) of the device. Microphone 132 captures a first (primary) left signal $L_2$, microphone 134 captures a second (secondary) left signal $L_1$, microphone 136 captures a first (primary) right signal $R_1$, and microphone 138 captures a second (secondary) right signal $R_2$. As indicated, microphones 132 and 136 are both mounted in ports on a front face of the device 100. Thus, while all microphones of device 100 are omnidirectional, the port configuration gives microphones 132 and 136 a nominal direction of sensitivity indicated by the respective arrow, each being at a normal to a plane of the front face of the device. In contrast, microphones 134 and 138 are mounted in ports on opposed end surfaces of the device 100. Thus the nominal direction of sensitivity of microphone 134 is anti-parallel to that of microphone 138, and perpendicular to that of microphones 132 and 136. The following embodiments describe the capture of audio using such a device, for example to accompany a video recorded by a camera (not shown) of the device.

Figure 2:
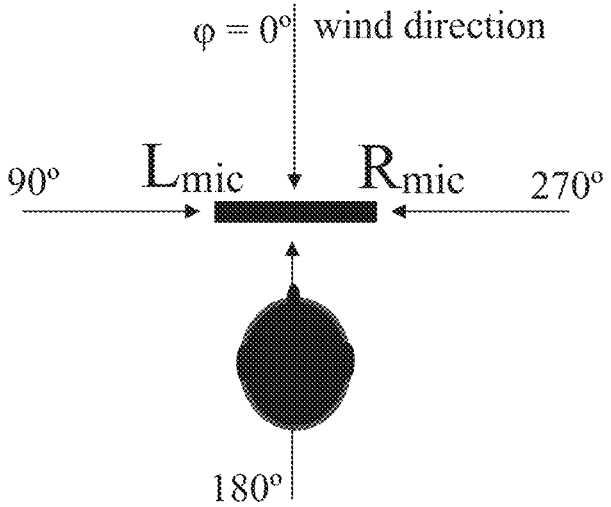
FIG. 2 illustrates a use case for the device of FIG. 1, when used as a video/audio recorder.

When used as a video/audio recorder, the typical device positioning is shown in FIG. 2, where the angle $\varphi$ represents wind direction with respect to the device.

Figure 3:
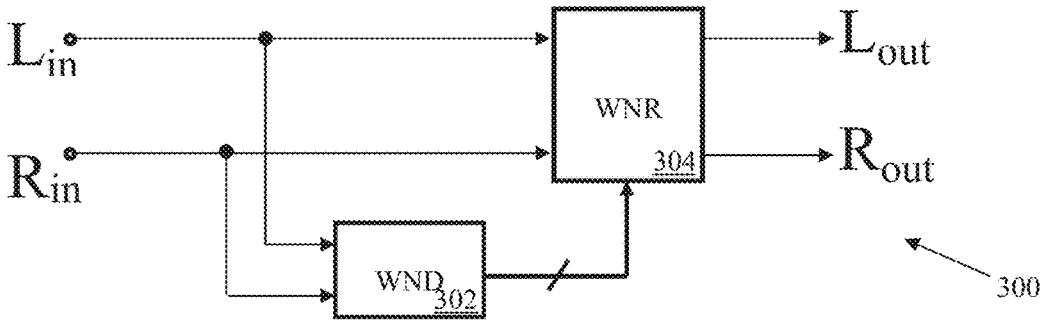
FIG. 3 is a block diagram of a wind noise reduction system in accordance with one embodiment of the present invention.

A block diagram of a wind noise reduction system 300 in accordance with one embodiment of the present invention is shown in FIG. 3. It is common to combine the digitised (quantised and discretised) samples from $L_{mic}$(132) and $R_{mic}$ (136) into frames of certain duration (number of elements, M). The input frames are input to the Wind Noise Detector (WND) 302. The WND 302 analyses the frames from the left and right microphones 132, 136 and makes a decision whether, and in which pre-determined sub-band(s), the wind is present during this frame interval. The "per-sub-band"

wind presence decisions along with other detection parameters are supplied to the wind noise reduction (WNR) module 304 which applies a chosen technique to reduce wind noise in affected sub-bands while attempting to preserve the target signal (e.g. speech). Any suitable wind noise reduction technique may be applied. The WNR outputs $L_{out}$ and $R_{out}$ are output to the end user or for further processing.

Figure 4:
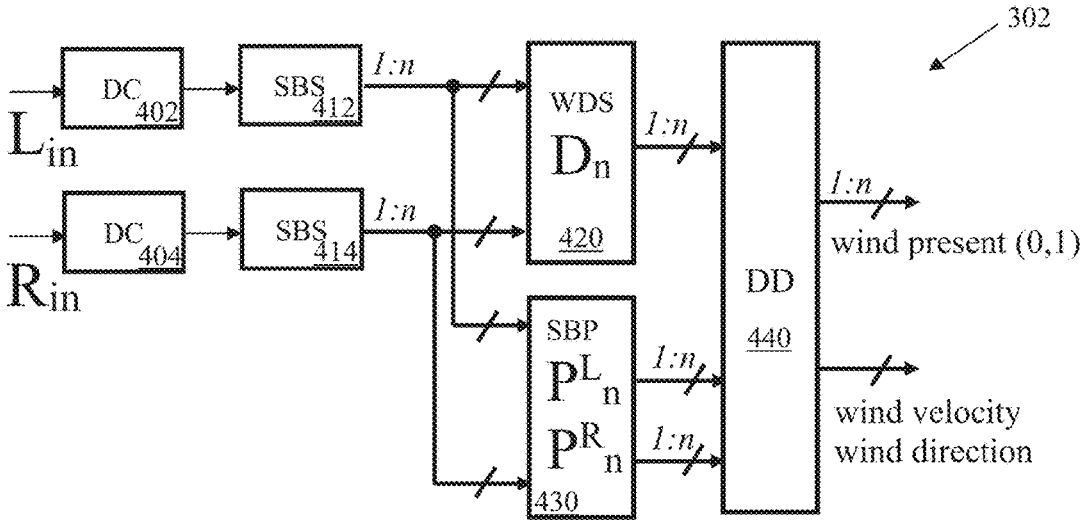
FIG. 4 is a block diagram of the wind noise detector utilised in the system of FIG. 3.

FIG. 4 shows a block diagram of the proposed wind noise detector 302.

Figure 6:
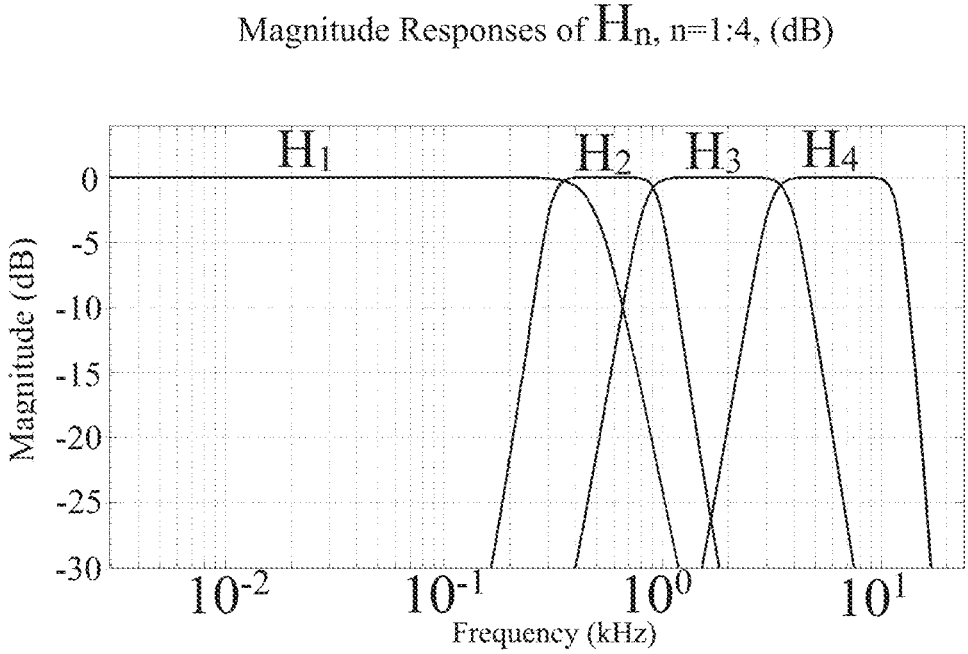
FIG. 6 illustrates the sub-bands implemented by the sub-band splitting module in the detector of FIG. 4.

The DC modules 402, 404 (one for each input channel) calculate and remove the DC component from the left and right input channels and supply the DC-free frames to the sub-band splitting (SBS) modules 412, 414. The SBS modules 412, 414 (one for each input channel) are used to split full-band frames from each (left and right) channel into N sub-bands. Each SBS module 412, 414 consists of N digital filters, each of which only passes on a designated frequency band, and stops (severely attenuates) the rest of the spectral content of the input signal. For example, if the input signal is sampled at $f_s$=48,000 Hz, each SBS may consist of N=4 filters $H_n$, n=1:4 each of which has the following pass-bands $B_n$: $B_1$=[0-500 Hz], $B_2$=[500-1,000 Hz], $B_3$=[1,000-4,000 Hz], and $B_4$=[4,000-12,000 Hz], as shown in FIG. 6.

Figure 7A:
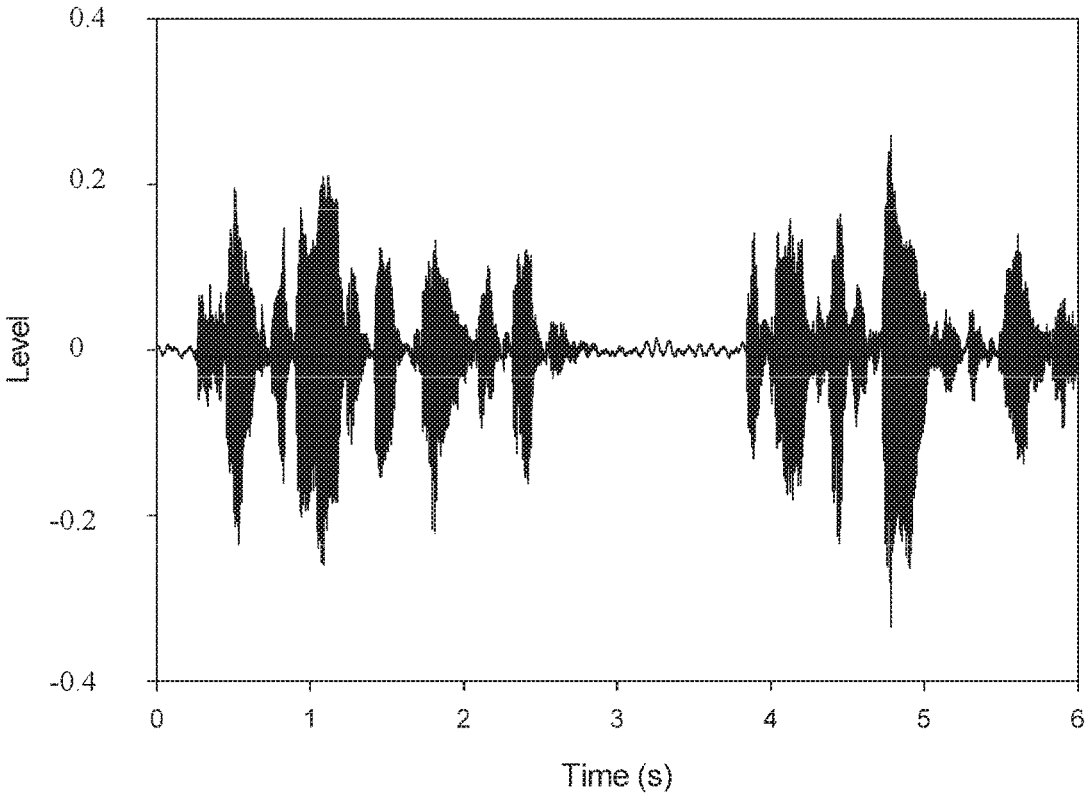
FIG. 7*a* illustrates a typical speech signal, unaffected by wind noise.
Figure 7B:
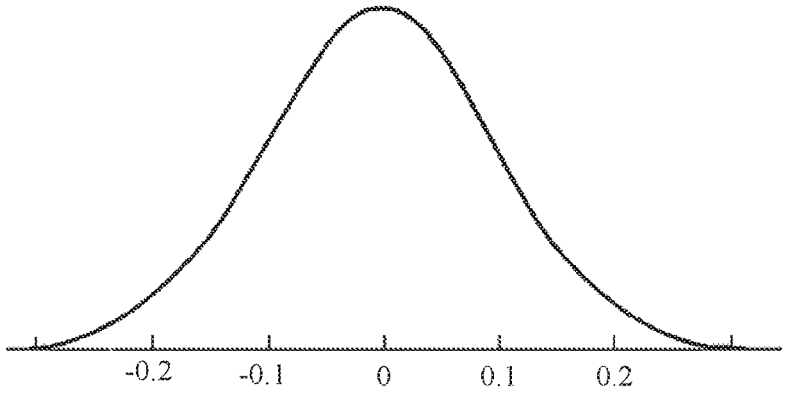
FIG. 7*b* illustrates the distribution of signal sample magnitudes in the signal of FIG. 7*a*.
Figure 7C:
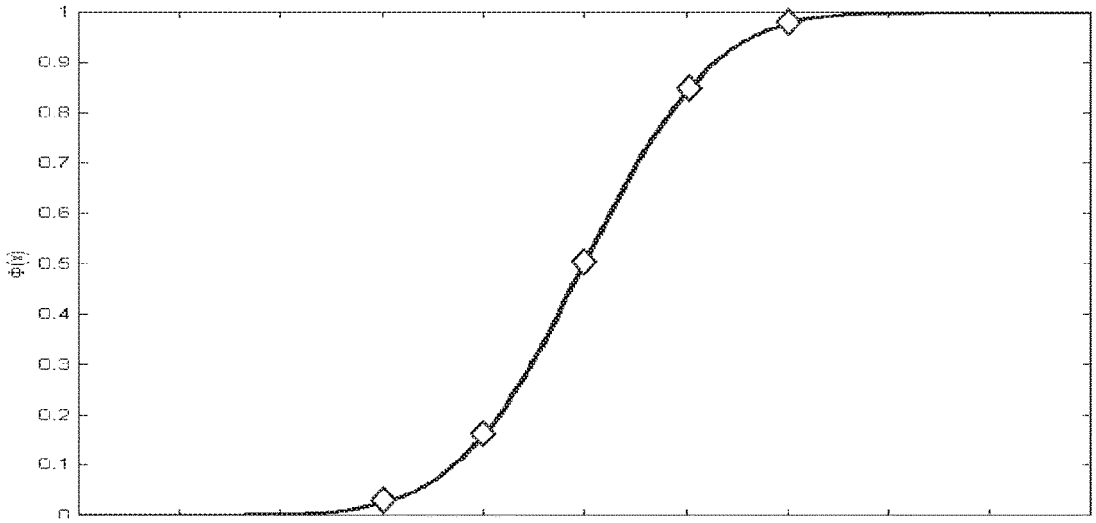
FIG. 7*c* illustrates the cumulative distribution of signal sample magnitudes in the signal of FIG. 7*a;*
Figure 8:
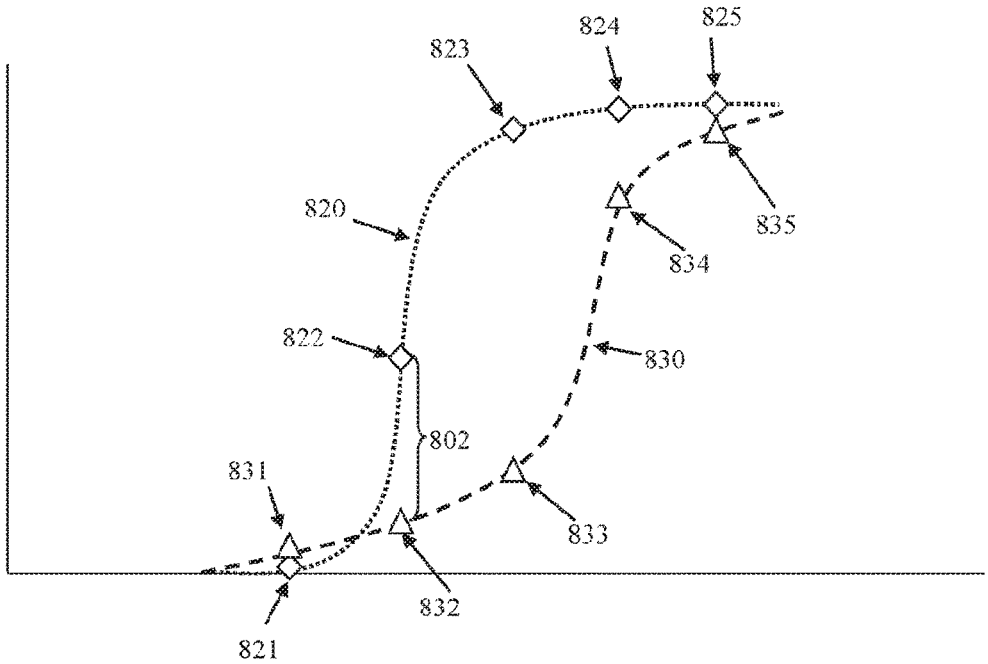
FIG. 8 illustrates calculation of the difference between the first and second signal distributions when affected by wind noise.

FIG. 7*a* illustrates a typical speech signal, unaffected by wind noise. As can be seen, and as illustrated in FIG. 7*b* the distribution of signal sample magnitudes in the signal of FIG. 7*a* is a normal distribution about zero. FIG. 7*c* illustrates the cumulative distribution of signal sample magnitudes in the signal of FIG. 7*a*. However, FIG. 8 illustrates how the first and second signal cumulative distributions 820, 830 might appear when affected by wind noise. It is noted that the distributions 820, 830 in FIG. 8 are shown as dotted lines, because only selected points on each distribution need to be determined in order to put the present embodiment of the invention into effect, and the precise curve need not be determined over its full length at other values. In the present embodiment, five selected values of each distribution 820, 830 are determined, namely the respective cumulative distribution values at points 821-825 on curve 820, and the respective cumulative distribution values at points 831-835 on curve 830. Then, the absolute value of the differences between the distributions at those values are determined, with one of these five difference values, between the value at 822 and the value at 832, being indicated at 802. As occurs between points 821 and 822, the curves 820 and 830 may cross one or more times, and this is why the absolute values are taken of the differences. Finally, the absolute values of the differences are summed, in order to produce a scalar metric reflecting wind noise.

A suitable process for determining the metric portrayed in FIGS. 7 and 8 is as follows. The N output frames from each left and right SBS module 412, 414 are fed into the wind detection statistic (WDS) calculator module 420 which calculates wind detection statistics $D_n$, n=1:N, one for each of N sub-bands, as follows.

i. Set n=1 (select first sub-band).

ii. Calculate empirical distribution functions, EDF, $F_M^{Left}$(n,x) and $F_M^{Right}$(n,x) of the left and right channels:

$$F_M^{Left}(n, x_l) = \frac{1}{M}\sum_{m=1}^{M} I_{X_{n,m}^{Left} \le x_l}$$

$$F_M^{Right}(n, x_l) = \frac{1}{M}\sum_{m=1}^{M} I_{X_{n,m}^{Right} \le x_l}$$

where

M is the frames size in samples, $X_{n,m}^{Left}$ and $X_{n,m}^{Right}$ are the m-th samples of the n-th sub-band coming from the left and right channels respectively.

$x_l$ point over which the EDFs are calculated so that the vector $\vec{x}=x_l$ (l=1: L) represents the domain of the EDFs, and L represents its cardinality, and $I_{X_m \le x_l}$ is the indicator function, which is equal to 1 if $X_m \le x_l$ and equal to 0 otherwise.

iii. Calculate wind detection statistics (WDS):

$$D_n = \frac{1}{L}\sum_{l=1}^{L} \left|F_M^{Left}(n, x_l) - F_M^{Right}(n, x_l)\right|$$

iv. Smooth calculated Dn by applying leaky integrator $$\tilde{D}_{n,k}=\alpha D_{n,k}+(1-\alpha)\tilde{D}_{n,k-1}$$

where $\tilde{D}_{n,k}$ is a smoothed value of $D_{n,k}$,

α is leaky integrator tap, k is the frame index, and n is the sub-band index.

v. Increment sub-band index n and repeat above steps until all $\tilde{D}_n$, n=1:N are calculated.

The values and the size of the vector $\vec{x}=x_l$, l=1: L are chosen empirically based on the dynamic range of the input signal $\vec{X}=X_m$, m=1: M and may be determined using the histogram method so that $\vec{x}$ spans 60-90% of the signal dynamic range. In practice, L<12 is sufficient. Once determined, $\vec{x}$ and L need not change.

In the Sub-Band Power (SBP) calculator module 430 the N output frames from each left and right SBS module 412, 414 are received and used to calculate sub-band powers $P_n^{Left}$ and $p_n^{Right}$, n=1:N, one for each of the N sub-bands, as follows.

i. Set in =1 (select first sub-band).

ii. Calculate sub-band powers, $P_n^{Left}$ and $P_n^{Left}$ of the left and right channels:

$$P_n^{Left}=\Sigma_{m=1}^{M}|X_{n,m}^{Left}|^2$$

$$P_n^{Right}=\Sigma_{m=1}^{M}|X_{n,m}^{Right}|^2$$

where

M is the frames size in samples, and $X_{n,m}^{Left}$ and $X_{n,m}^{Right}$ are the m-th samples of the n-th sub-band coming from the left and right channels respectively.

iii. Smooth calculated $P_n^{Left}$ and $P_n^{Right}$ by applying a leaky integrator:

$$\tilde{P}_{n,k}^{Left}=\alpha P_{n,k}^{Left}+(1+\alpha)\tilde{P}_{n,k-}^{Left}$$

$$\tilde{P}_{n,k}^{Right}=\alpha P_{n,k}^{Right}+(1+\alpha)\tilde{P}_{n,k-}^{Right}$$

where $\tilde{P}_{n,k}^{Left}$ and $\tilde{P}_{n,k}^{Right}$ are the smoothed values of left and right sub-band powers, and α is leaky integrator tap iv. Convert the smoothed sub-band powers to dB.

v. Increment the sub-band index n and repeat from the first step until all $\tilde{P}_n^{Left}$ and $\tilde{P}_n^{Right}$, n=1:N are calculated.

In the Decision Device (DD) module 440 the calculated N wind detections statistics $\tilde{D}_n$ and sub-band powers $\tilde{P}_n^{Left}$ and $\tilde{P}_n^{Right}$ are used to make a decision about wind presence in the n-th sub-band, and to produce estimates of wind velocity and wind direction. However it is also possible in other embodiments of the invention to make a determination as to the presence of wind noise without using the sub-band powers $\tilde{P}_n^{Left}$ and $\tilde{P}_n^{Right}$, and so in alternative embodiments the velocity and direction values need not be calculated, particularly if these values are also not required for wind direction estimation.

Figure 5:
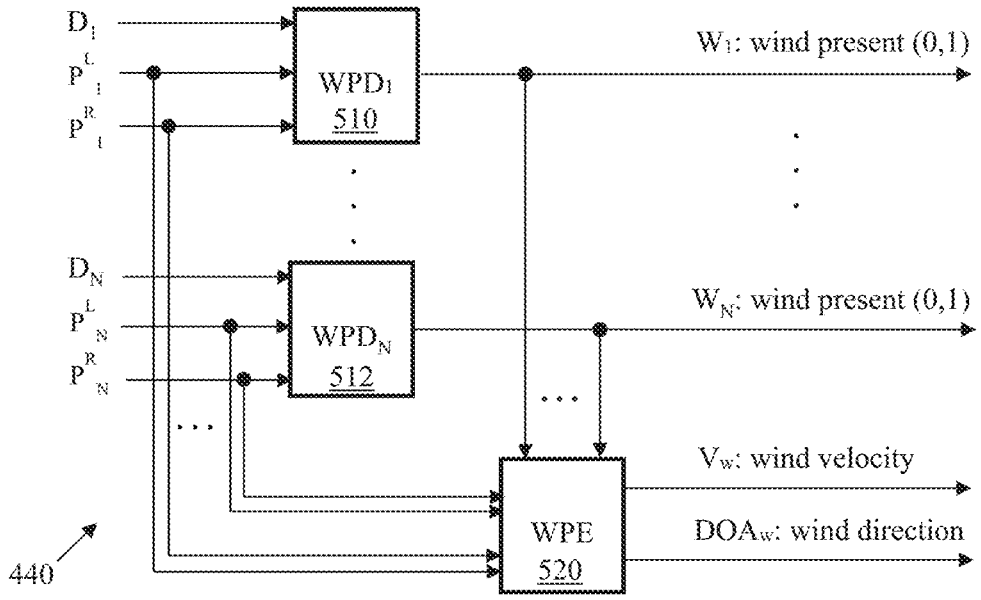
FIG. 5 is a block diagram of the decision module utilised in the detector of FIG. 4.

FIG. 5 shows a block diagram of the DD module 440 in one embodiment of the invention. The DD module 440 consists of N Wind Presence Decision (WPD) processor modules 510 . . . 512, and a Wind Parameter Estimator (WPE) module 520.

In the WPD each n-th, n=1:N of wind presence decision processor, $WPD_n$, 510-512, is input with the corresponding wind detection statistic $\tilde{D}_n$ determined by wind detection statistic (WDS) calculator module 420, and sub-band powers $\tilde{P}_n^{Left}$ at and $\tilde{P}_n^{Right}$ determined by the Sub-Band Power (SBP) calculator module 430. A binary decision on whether wind is present in the n-th sub-band is made by WPDs 510-512 as follows.

$$W_n = \begin{cases} 1, & \tilde{D}_n > DTHR_n,\ \tilde{P}_n^{Left} \text{ and } \tilde{P}_n^{Right} > PTHR_n \\ 0, & \text{otherwise} \end{cases}$$

where $DTHR_n$ is a threshold value for $\tilde{D}_n$ in the n-th sub-band; $DTHR_n$ is determined empirically;

$PTHR_n$ is a threshold value for $\tilde{P}_{n,k}^{Left}$ and $\tilde{P}_{n,k}^{Right}$ in the n-th sub-band; $PTHR_n$ may be set to be just above the microphone (left and right) noise power; and $W_n$ is a wind presence indicator for the n-th sub-band.

Figure 9:
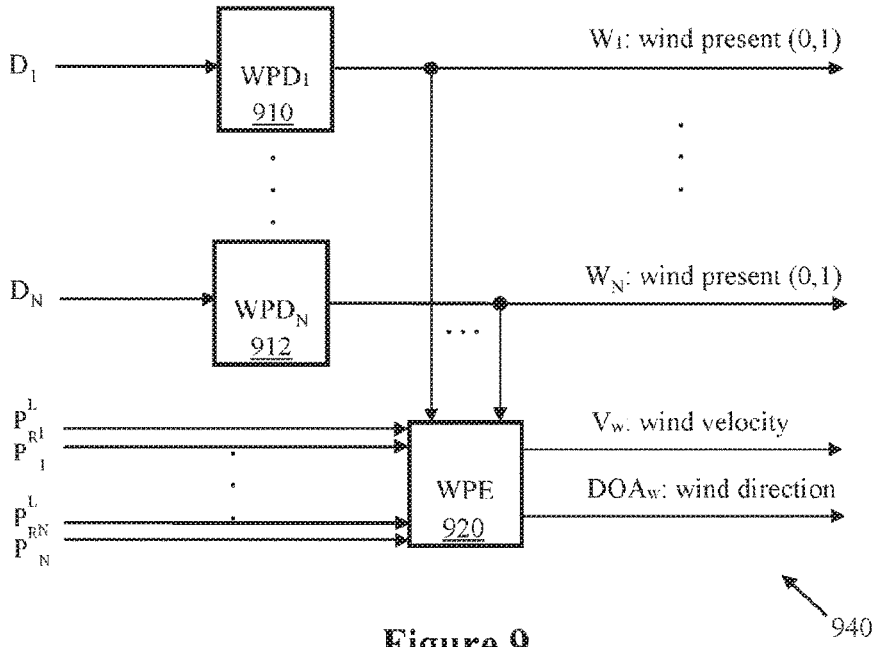
FIG. 9 is a block diagram of an alternative decision module which may be utilised in the detector of FIG. 4.

In an alternative embodiment of the DD module, as shown in DD module 940 in FIG. 9, the use of sub-band powers $\tilde{P}_n^{Left}$ and $\tilde{P}_n^{Right}$ from the Sub-Band Power (SBP) calculator module 430 may be omitted from the decision device. In such embodiments a binary decision on whether wind is present in the n-th sub-band can be made in each WPD module 910-912 as follows:

$$W_n = \begin{cases} 1, & \tilde{D}_n > DTHR_n, \\ 0, & \text{otherwise} \end{cases}$$

where $DTHR_n$ is a threshold value for $\tilde{D}_n$ in the n-th sub-band; $DTHR_n$ being determined empirically, and $W_n$ is a wind presence indicator for the n-th sub-band.

As wind noise energy is concentrated at the low portion of the spectrum and steadily declines at high frequency portion of the spectrum, the decision metric $W_{n+1}$ is calculated only if decision $W_n$ was positive.

The wind presence decision vector $\vec{W}=\{W_1, W_2, \ldots, W_N\}$ is output from the DD 440 or 940 to indicate whether wind is detected at the n-th sub-band during a current frame interval, so that if $W_n=1$ then wind is detected at the n-th sub-band, and $W_n=0$ if it is not.

Wind parameters estimation is performed at 520 or 920 only if wind detection was positive, which means that at least the output from $WPD_l$ 510 $W_l=1$.

The Wind Parameter Estimator 520 or 920 is input with wind presence decision vector $\vec{W}=\{W_1, W_2, \ldots, W_N\}$ for all N sub-bands and also all with sub-band powers $\tilde{P}_n^{Left}$ and $\tilde{P}_n^{Right}$, n=1:N The WPE 520, 920 performs wind parameter estimation as follows.

Figure 10:
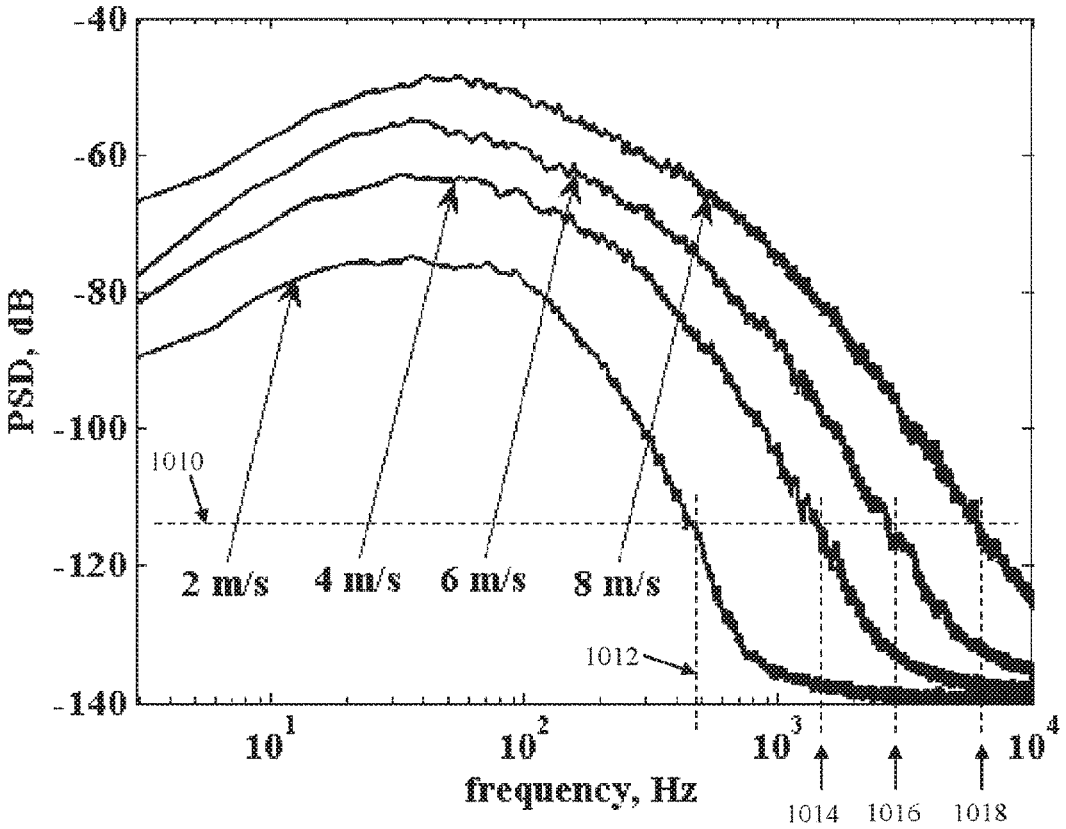
FIG. 10 illustrates the spectra of wind noise at differing winds speeds.

Wind Velocity, $V_w$. The wind velocity is estimated by determining the variable cut-off frequency $f_c$ of the wind spectrum based on the values of $W_n$ in each n-th sub-band. The cut-off frequency $f_c$ is estimated as the right-side pass-band frequency of the highest sub-band $B_n$ where wind was detected. The frequency resolution of $f_c$ estimation is determined by the number N and widths (granularity) of the sub-bands $B_n$. Relations $V_W=F(f_c)$ between wind velocity and wind spectrum cut-off frequency may be established empirically and stored in a lookup table to enable a wind velocity estimate to be output. For example FIG. 10 illustrates an example of the power spectrum of wind-induced noise recorded at φ=0° wind attack angle and four wind speeds, namely 2 m/s, 4 m/s, 6 m/s, and 8 m/s. As it may be seen, the wind noise spectrum is generally a decreasing function of frequency, and its cut-off frequency is a function of wind velocity. Device configuration and other factors also affect the wind noise spectrum, and it is to be appreciated in other embodiments that an alternative relationship between wind velocity and wind spectrum cut-off frequency for a different device or configuration can be equivalently determined. A wind noise detection threshold set at level 1010 may thus be empirically used to determine that if the variable cut-off frequency $f_c$ of the wind spectrum is around 500 Hz as indicated at 1012 then the wind speed is about 2 m/s. Similarly, variable cut-off frequencies $f_c$ of the wind spectrum of 2 kHz, 4 kHz and 6 kHz as indicated at 1014, 1016, 1018, can be taken to indicate that the wind speed is 4 m/s, 6 m/s and 8 m/s, respectively.

It is to be noted in FIG. 10 that, although the bulk of wind energy is concentrated between 10-500 Hz, it is evident that at higher velocities the wind noise level remains above the microphone noise level even at frequencies larger than 10 kHz. With increasing wind velocity, the wind-induced noise progresses into the higher frequency portion of the spectrum. Select embodiments of the present invention thus provide for wind noise to be detected in each affected band, and removed by applying a chosen wind noise reduction technique. On the other hand, with wind speed decreasing, the bulk of wind-induced noise power moves to the low-frequency part of the spectrum, leaving a significant portion of the high-frequency content of audio signal spectrum relatively unaffected, where wind noise reduction need not be applied. By refraining from applying wind noise reduction in unaffected bands, a more natural sound is retained in the output audio, and a reduced processing load is incurred.

Wind Direction, $DOA_w$. Wind direction with respect to the device 100 may be estimated by WPE 520, 920 by analysing the sign of the left/right channel power difference in the lowest sub-band where wind was detected, which is $B_l$. So, if $W_n=1$, then calculate power difference $\Delta P=\tilde{P}_n^{Left}-\tilde{P}_n^{Right}$, if $\Delta P>\delta$ then wind is coming from the left; if $\Delta P<-\delta$ then wind is coming from the right; otherwise wind is coming from the front (or rear); δ is a small positive number, i.e.

$DOA_w$='Left', if $\Delta P>\delta$ $DOA_w$='Right', if $\Delta P>-\delta$ $DOA_w$='Front or Rear', if $\Delta P<\delta$ and $\Delta P>-\delta$ Although the complex localised nature of wind flow, and thus wind noise, makes it difficult for the wind direction estimator 520, 920 to give a precise estimate of the direction of arrival of the wind, the above coarse estimation of a quadrant in which the direction of wind arrival resides is nevertheless a valuable indicator.

Figure 11:
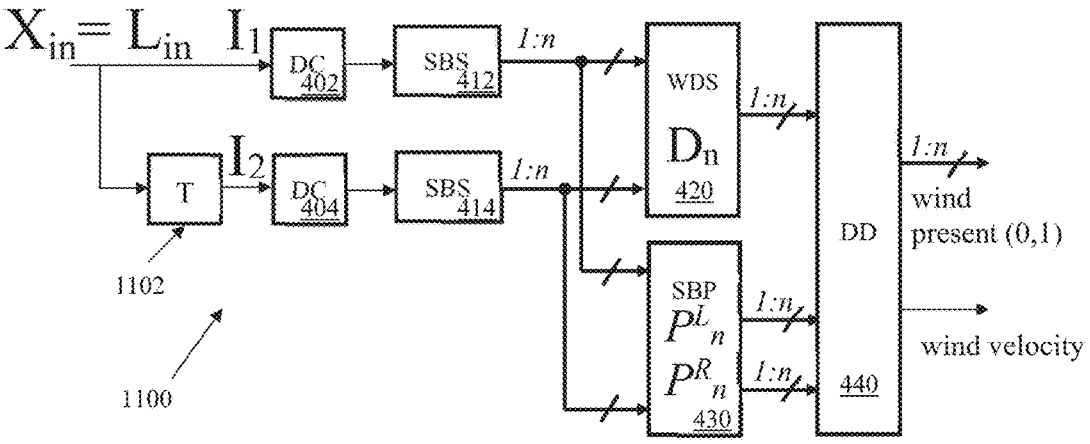
FIG. 11 is a block diagram of another embodiment providing single-microphone wind noise detection.

FIG. 11 is a block diagram of another embodiment of the invention, which provides a single-microphone implementation of the present invention. In the system 1100, most of the processing is the same as the processing in the dual-microphone wind noise detector 302, as indicated by repeated reference numerals 402, 404, 412, 414, 420, 430, 440.

However in the system 1100, both the first input signal $I_1$ input to the DC removal block 402 and the second input signal 12 input to the DC removal block 404 are derived from a single microphone input signal $X_{in}$. In particular, the first input signal $I_1$ comprises the audio frame from the microphone received at the current, i-th, time interval. On the other hand, the second input signal $I_2$ is the frame from the same microphone received at the previous frame interval, i−1, due to the operation of the single frame delay 1102. In particular the module 1102 is used to produce the second signal frame 12 by applying a single-frame delay to the input signal $X_{in}$. The wind direction of arrival DOA is not estimated in system 1100 due to the absence of spatial diversity in the input signals. This embodiment thus recognises that the effect illustrated by comparing FIG. 7*c* to FIG. 8 arises in the presence of wind noise even from one frame to the next in a single microphone system. Thus, comparing the cumulative distribution values from one frame to the next also enables a metric reflecting wind noise to be produced.

Figure 12:
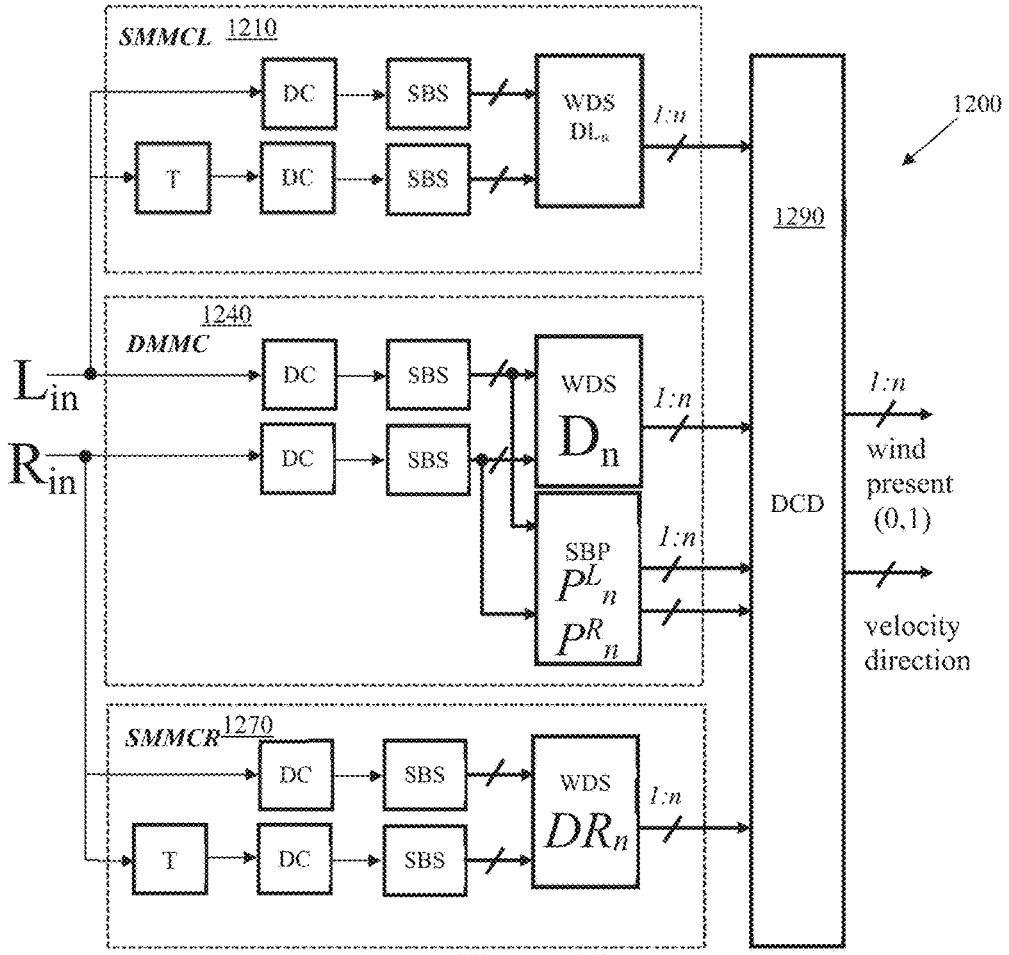
FIG. 12 is a block diagram of yet another embodiment, providing both single-microphone and dual-microphone wind noise detection.

FIG. 12 shows a dual-microphone wind detector 1200 in accordance with yet another embodiment of the invention, in which both spatial and temporal wind detection metrics are determined and utilised. This embodiment recognises that it is beneficial to combine both the wind detectors of FIGS. 4 and 11, for improved wind detection performance. The WND 1200 comprises two single-microphone detection metric calculators, SMMCL 1210 and SMMCR 1270, which are input with the left and right microphone signals respectively. The WND 1200 further comprises a dual-microphone detection metric calculator, DMMC 1240, which is input with both left and right microphone signals. The WND 1200 further comprises a decision combining device, DCD 1290.

The single-microphone metric calculator for the left microphone. SMMCL 1210, is input with framed audio samples $L_{in}$ from the left microphone. The metric calculator 1210 estimates wind detection statistics $DL_n$=1:N, one for each of N sub-bands, based on the audio frames from the left microphone, in the same manner as described for WND 1100 in relation to FIG. 11.

Similarly, the single-microphone metric calculator for the right microphone SMMCR 1270, is input with framed audio samples from the right microphone. The metric calculator estimates wind detection statistics $DR_n$, n−1:N, one for each of N sub-bands, based on the audio frames from the right microphone, in the same manner as described for WND 1100 in relation to FIG. 11.

The dual-microphone metric calculator 1240 is input with (framed) samples from the left and right microphones. The metric calculator estimates wind detection statistics $D_n$ and sub-band powers, $P_n^{Left}$ and $P_n^{Right}$ of the left and right channels, one for each of N sub-bands, based on the audio frames from both left and right microphones, in the same manner as described for WND 302 in relation to FIGS. 4-10.

The wind decision statistics $DL_n$, $D_n$, and $DR_n$, output by 1210, 1240, 1270, respectively, are smoothed in time to produce smoothed wind decision statistics $\widetilde{DL}_n$, $\tilde{D}_n$, and $\widetilde{DR}_n$. Similarly, the N sub-band powers, $P_n^{Left}$ and $P_n^{Right}$ output by 1240 are smoothed in time to produce smoothed sub-band powers $\tilde{P}_n^{Left}$ and $\tilde{P}_n^{Right}$.

The decision combining device, DCD 1290, receives the smoothed statistics $\widetilde{DL}_n$, $\widetilde{DR}_n$, and $\tilde{D}_n$ and sub-band powers $\tilde{P}_n^{Left}$ and $\tilde{P}_n^{Right}$, and makes a decision as to whether wind is present in each of the n-th sub-bands. The wind presence decision metric is produced by combining temporal, $\widetilde{DL}_n$, $\widetilde{DR}_n$, and spatial, $\tilde{D}_n$, wind statistics into an aggregate statistic. $\widetilde{DA}_n$. In this embodiment $\widetilde{DA}_n$ is calculated by finding the largest wind statistic for each sub-band:

$$\widetilde{DA}_n=\max(\widetilde{DL}_n,\widetilde{DR}_n,\tilde{D}_n)$$

It is to be appreciated that any other suitable combining method may be utilised in other embodiments of the present invention to produce the aggregate statistic DCD 1290 further produces estimates of wind velocity and direction, in the manner described in relation to WPE 520 & 920.

It will be appreciated by persons skilled in the art that numerous variations and/or modifications may be made to the invention as shown in the specific embodiments without departing from the spirit or scope of the invention as broadly described. For example, while being described in respect of a handheld device 100, the present invention may alternatively be applied in respect of a single hearing aid bearing two or more microphones, in respect of binaural hearing aids mounted upon respective sides of a user's head, or in respect of mobile phones, Personal Digital Assistants or tablet computers for example. The present embodiments are, therefore, to be considered in all respects as illustrative and not limiting or restrictive.

The invention claimed is:

1. A method of processing digitized microphone signal data in order to detect wind noise, the method comprising:

obtaining a first signal and a second signal from at least one microphone, the first and second signals reflecting a common acoustic input, and the first and second signals being at least one of temporally distinct and spatially distinct;

processing the first signal to determine a first distribution of the samples of the first signal;

processing the second signal to determine a second distribution of the samples of the second signal;

calculating a difference between the first distribution and the second distribution; and if the difference exceeds a detection threshold, outputting an indication that wind noise is present.

2. The method of claim 1 wherein the first and second signals are made to be temporally distinct by taking temporally distinct samples.

3. The method of claim 2 wherein the temporally distinct samples are taken from a single microphone signal.

4. The method of claim 1 wherein first and second signals are made spatially distinct by taking the first signal from a first microphone and taking the second signal from a second microphone spaced apart from the first microphone.

5. The method of claim 4 wherein each microphone signal is matched for amplitude so that an expected variance of each signal is the same or approximately the same.

6. The method of claim 4 wherein the first and second microphone signals are matched for an acoustic signal of interest before the wind noise detection is performed.

7. The method of claim 1 wherein the distribution of each of the first and second signals comprises a cumulative distribution of signal sample magnitude.

8. The method of claim 1 wherein the distribution of each of the first and second signals is determined only at one or more selected values.

9. The method of claim 8 wherein calculating the difference between the first distribution and the second distribution is performed by calculating the point-wise difference between the first and second distribution at each selected value, and summing the absolute values of the point-wise differences to produce a measure of the difference between the first distribution and the second distribution.

10. The method of claim 1 wherein the or each microphone signal is high pass filtered to remove any DC component.

11. The method of claim 1, performed on a frame-by-frame basis by comparing the distribution of samples from a single frame of each signal.

12. The method of claim 1 wherein the difference between the first distribution and the second distribution is smoothed over multiple frames.

13. The method of claim 1 wherein the detection threshold is set to a level which is not triggered by light winds.

14. The method of claim 13 wherein the detection threshold is set to a level which is not triggered by wind below 2 $m \cdot s^{-1}$.

15. The method of claim 1 wherein the magnitude of the difference between the first distribution and the second distribution is used to estimate the strength of the wind in otherwise quiet conditions, or the degree by to which wind noise is dominating other sounds present, within clipping limits.

16. The method claim 1, performed in respect of one or more sub-bands of a spectrum of the signal.

17. The method of claim 16 wherein detection of wind noise is first performed in respect of a lower frequency sub-band, and is only performed in respect of a higher frequency sub-band if wind noise is detected in the lower frequency sub-band.

18. The method of claim 16 further comprising performing wind noise reduction only in each sub-band in which the presence of wind noise has been detected.

19. The method of claim 16, wherein the sub-band(s) within which the presence of wind noise is detected is used to estimate the strength of the wind.

20. A device for detecting wind noise, the device comprising:

at least a first microphone; and a processor configured to:

obtain a first signal and a second signal from the at least one microphone, the first and second signals reflecting a common acoustic input, and the first and second signals being at least one of temporally distinct and spatially distinct;

process the first signal to determine a first distribution of the samples of the first signal;

process the second signal to determine a second distribution of the samples of the second signal;

calculate a difference between the first distribution and the second distribution; and if the difference exceeds a detection threshold, output an indication that wind noise is present.

21. A non-transitory computer-readable medium comprising computer program code means to make a computer execute a procedure for wind noise detection, the non-transitory computer-readable medium comprising:

computer program code means for obtaining a first signal and a second signal from at least one microphone, the first and second signals reflecting a common acoustic input, and the first and second signals being at least one of temporally distinct and spatially distinct;

computer program code means for processing the first signal to determine a first distribution of the samples of the first signal;

computer program code means for processing the second signal to determine a second distribution of the samples of the second signal;

computer program code means for calculating a difference between the first distribution and the second distribution; and computer program code means for, if the difference exceeds a detection threshold, outputting an indication that wind noise is present.

* * * * *